US012338563B2

(12) United States Patent
Bagley et al.

(10) Patent No.: US 12,338,563 B2
(45) Date of Patent: Jun. 24, 2025

(54) CLOSE STITCH HOPPING FOOT

(71) Applicant: Gracewood Management, Inc., West Jordan, UT (US)

(72) Inventors: Jim Matthews Bagley, West Valley City, UT (US); Karla Gerome, West Valley City, UT (US)

(73) Assignee: Gracewood Management, Inc., West Jordan, UT (US)

( * ) Notice: Subject to any disclaimer, the term of this patent is extended or adjusted under 35 U.S.C. 154(b) by 0 days.

(21) Appl. No.: 18/475,711

(22) Filed: Sep. 27, 2023

(65) Prior Publication Data

US 2024/0102219 A1 Mar. 28, 2024

Related U.S. Application Data

(60) Provisional application No. 63/377,398, filed on Sep. 28, 2022.

(51) Int. Cl.
*D05B 29/08* (2006.01)
*D05B 29/12* (2006.01)
*D05B 35/10* (2006.01)

(52) U.S. Cl.
CPC ..... *D05B 29/08* (2013.01); *D05B 29/12* (2013.01); *D05B 35/10* (2013.01)

(58) Field of Classification Search
CPC ..... D05B 29/06; D05B 29/08; D05B 29/12; D05B 35/10; D05B 11/00; D05C 11/16
See application file for complete search history.

(56) References Cited

U.S. PATENT DOCUMENTS 31,646 A * 3/1861 Moulson ..... D05B 29/06 112/235
751,057 A * 2/1904 Cooper et al. ..... D05B 3/02 112/98
1,431,591 A * 10/1922 Lucy ..... D05B 21/00 112/102
1,934,190 A 11/1933 Harker
(Continued)

FOREIGN PATENT DOCUMENTS

CH 686681 A5 5/1996
GB 2505152 A 2/2014
(Continued)

OTHER PUBLICATIONS

Stormshopping; "Multifunctional Daisy Flower Stitch Circles Embroidery Presser Foot for Singer Brother Janome and Other Low Shank Sewing Machine by Stormshopping"; Retrieved from: https://www.amazon.com/Multifunctional-Circles-Embroidery-Presser-Stormshopping/dp/B072LW3W38 ; Available at least as early as Oct. 8, 2020; 9 pages.
(Continued)

*Primary Examiner* — Patrick J. Lynch
(74) *Attorney, Agent, or Firm* — Ryan L. Marshall; Jessica Kiser; Barnes & Thornburg LLP

(57) ABSTRACT

A hopping foot assembly for a sewing machine having a needle comprises a hopping foot base and a hopping foot
(Continued)

arm. The hopping foot base is shaped to include a needle opening that extends axially therethrough relative to an axis. The hopping foot arm extends from the hopping foot base. The hopping foot arm is configured to be coupled to the sewing machine to fix the hopping foot base relative to the sewing machine.

20 Claims, 7 Drawing Sheets

(56) References Cited

U.S. PATENT DOCUMENTS

| | | | | |
|---|---|---|---|---|
| 2,790,404 | A | 4/1957 | Somers et al. | |
| 3,425,378 | A * | 2/1969 | Kaplan | D05B 29/08 112/235 |
| 3,693,561 | A * | 9/1972 | Hrinko, Jr. | D05B 35/102 112/470.07 |
| 5,515,797 | A * | 5/1996 | Janouschek | D05B 29/08 112/235 |
| 8,234,989 | B2 | 8/2012 | Thomas et al. | |
| 8,453,587 | B2 | 6/2013 | Bagley | |
| 10,407,812 | B2 | 9/2019 | Labes et al. | |
| 10,612,173 | B2 | 4/2020 | Groelz et al. | |
| 2004/0060494 | A1 * | 4/2004 | Martelli | D05B 29/08 112/150 |
| 2011/0100276 | A1 * | 5/2011 | Thomas | D05B 11/00 112/117 |
| 2013/0112128 | A1 * | 5/2013 | Bagley | D05B 29/08 112/237 |
| 2020/0181820 | A1 | 6/2020 | Mitchell | |
| 2021/0317603 | A1 * | 10/2021 | Eriksson | D05B 43/00 |

FOREIGN PATENT DOCUMENTS

| | | | |
|---|---|---|---|
| WO | WO-2018015584 | A1 * | 1/2018 |
| WO | 2022198226 | A1 | 9/2022 |
| WO | 2022198227 | A1 | 9/2022 |

OTHER PUBLICATIONS

Handi Quilter, Inc; "Handi Quilter Echo Feet Kit"; Retrieved from: https://www.amazon.com/Handi-Quilter-Echo-Feet-Kit/dp/B075R9MW5K ; Available at least as early as Oct. 8, 2020; 7 pages.

Brother; "Free Motion Echo Quilting Foot, Brother #XE0766001"; Retrieved from: https://www.sewingpartsonline.com/free-motion-echo-quilting-foot-brother-xe0766001.aspx?gclid=EAlalQobChMI26WQze-g7AIVjf7jBx1eBwSvEAQYBiABEgLGzvD_BwE on Oct. 6, 2020; 6 pages.

Johnson, Liz; "Janome Clear View Quilting Foot and Guide Set"; Retrieved from: https://sew4home.com/accessories-we-love-clear-view-quilting-foot-and-guide-set-from-janome/ ; Aug. 21, 2018; 15 pages.

Martelli Enterprises , "Bella Sedere—Presser Feet Demo" , Retrieved from: https://www.youtube.com/watch?v=he-LInlAoJQ, Uploaded Feb. 17, 2016.

* cited by examiner

CLOSE STITCH HOPPING FOOT

CROSS-REFERENCE TO RELATED APPLICATIONS

This application claims the benefit of U.S. Provisional Application No. 63/377,398, filed Sep. 28, 2022, the entire contents of this application is hereby incorporated by reference herein.

FIELD OF DISCLOSURE

The present disclosure relates generally to sewing or quilting machines, and more specifically to a hopping foot for sewing or quilting machines.

BACKGROUND

Sewing machines are used for stitching one or more pieces of fabric with thread. Some sewing machines are stationary such that fabric is feed under a needle of the sewing machine, while other sewing machines, like quilting machines, are maneuverable such that the needle may be moved across the fabric.

Maneuverable sewing machines allow a user to create intricate patterns with the stitching. Such sewing or quilting machines, however, may also make it difficult to accurately follow a path on the fabric, such as a seam, a ditch line, or another desired pattern.

A hopping foot and ruler may be used with the sewing machine to help guide the needle along the path. It remains difficult, however, to maneuver the machine and the ruler simultaneously.

SUMMARY

The present disclosure may comprise one or more of the following features and combinations thereof.

A hopping foot assembly for a sewing machine having a needle may comprise a circular hopping foot base, a hopping foot arm the extends axially from the hopping foot base relative to the axis of the hopping foot assembly, and a ruler guide. The circular hopping foot base may be shaped to include an outer surface and an inner surface that defines a needle opening. The needle opening may extend axially through the hopping foot base relative to an axis of the hopping foot assembly to allow the needle to extend into and out of fabric during use of the sewing machine. The hopping foot arm may be configured to be coupled to the sewing machine to fix the hopping foot base relative to the sewing machine. The rotating ruler guide may be coupled to the inner surface of the hopping foot base in the needle opening to define a portion of the needle opening.

In some embodiments, the rotating ruler guide may be configured to engage an edge of a ruler at two point-contact locations spaced apart from each other on either side of the needle so that the needle is located near the edge of the ruler. The rotating ruler guide may be configured to rotate about the axis of the hopping foot assembly relative to the hopping foot base to maintain engagement of the rotating ruler guide with the edge of the ruler at the two point-contact locations. This may allow a user to follow a path defined by the edge of the ruler with the needle of the sewing machine during use of the sewing machine.

In some embodiments, the rotating ruler guide may comprise a bearing and a guide attachment. The bearing may be coupled to the inner surface of the hopping foot base. The bearing may be configured to rotate about the axis of the hopping foot assembly. The guide attachment may be coupled to the bearing to rotate therewith.

In some embodiments, the guide attachment may comprise a guide-attachment body and a pair of guide arms. The guide-attachment body may extend around the axis of the hopping foot assembly to form an annular ring that defines the portion of the needle opening. The pair of guide arms may each extend radially inward from the guide-attachment body toward the needle of the sewing machine on opposite sides of the guide-attachment body. The pair of guide arms may be configured to engage the edge of the ruler at the two point-contact locations so as to align the needle with the path.

In some embodiments, the pair of guide arms may each be shaped to include a flange, a first protuberance, and a second protuberance. The flange may extend axially and radially inward from the guide-attachment body to a terminal end adjacent to the needle of the sewing machine. The flange may have a first side surface and a second side surface opposite the first side surface. The first protuberance may extend away from the first side surface of the flange near the terminal end of the flange. The second protuberance may extend away from the second side surface of the flange near the terminal end of the flange opposite the first protuberance.

In some embodiments, the first protuberances on the pair of guide arms or the second protuberances on the pair of guide arms may form the two point-contact locations that engage the edge of the ruler. The first protuberances on the pair of guide arms may form the two point-contact locations that engage the edge of the ruler. The second protuberances on the pair of guide arms may form the two point-contact locations that engage the edge of the ruler.

In some embodiments, the first and second protuberances on each guide arm included in the pair of guide arms may extend axially part way along the axis of the hopping foot assembly. The first and second protuberances on each guide arm may extend axially part way along the axis of the hopping foot assembly past a bottom surface of the hopping foot base. The first and second protuberances on each guide arm included in the pair of guide arms may extend axially part way along the axis of the hopping foot assembly.

In some embodiments, the pair of guide arms included in the guide attachment of the rotating ruler guide may each extend axially partway along the axis of the hopping foot assembly opposite the hopping foot arm. The pair of guide arms may each extend axially partway along the axis of the hopping foot assembly opposite the hopping foot arm so that the pair of guide arms extend past a bottom surface of the hopping foot base.

In some embodiments, the bearing may include an outer race, an inner race, and a roller located between the outer race and the inner race. The hopping foot base may be coupled to the outer race of the bearing. The guide-attachment body may be coupled to the inner race of the bearing.

In some embodiments, the path defined by the edge of the ruler may be linear or curved. The path defined by the edge of the ruler may be linear. The path defined by the edge of the ruler may be curved.

In some embodiments, the rotating ruler guide may comprise a guide-attachment body and a pair of guide arms. The guide-attachment body may extend around the axis of the hopping foot assembly to form an annular ring that defines the portion of the needle opening. The pair of guide arms may each extend axially and radially away from the guide-attachment body toward the needle of the sewing machine on opposite sides of the guide-attachment body. The pair of guide arms may be configured to engage the edge of the ruler at the two point-contact locations so as to align the needle with the path.

In some embodiments, the pair of guide arms may each be shaped to include a flange and a pair of protuberances. The flange may extend axially and radially inward from the guide-attachment body to a terminal end. The pair of protuberances may each extend away from the flange near the terminal end of the flange on opposite sides of the flange.

In some embodiments, one protuberance included in the pair of protuberances on a first guide arm included in the pair of guide arms and one protuberance included in the pair of protuberances on a second guide arm included in the pair of guide arms may form the two point-contact locations that engage the edge of the ruler. The pair of protuberances on each guide arm included in the pair of guide arms may each extend axially part way along the axis of the hopping foot assembly past a bottom surface of the hopping foot base.

According to another aspect of the present disclosure, a hopping foot assembly for a sewing machine having a needle may comprise a hopping foot base, hopping foot arm that extends from the hopping foot base, and a rotating ruler guide. The hopping foot base may be shaped to include a needle opening that extends axially therethrough relative to an axis of the hopping foot assembly. The hopping foot arm may be configured to be coupled to the sewing machine to fix the hopping foot base relative to the sewing machine. The rotating ruler guide may be coupled to the hopping foot base in the needle opening.

In some embodiments, the rotating ruler guide may be configured to engage an edge of a ruler at two point-contact locations other on either side of the needle. The rotating ruler guide may be configured to rotate about the axis of the hopping foot assembly relative to the hopping foot base to maintain engagement of the rotating ruler guide with the edge of the ruler at the two point-contact locations during use of the sewing machine.

In some embodiments, the rotating ruler guide may comprise a bearing and a guide attachment. The bearing may be coupled to the hopping foot base. The bearing may be configured to rotate about the axis of the hopping foot assembly. The guide attachment may be coupled to the bearing to rotate therewith.

In some embodiments, the guide attachment may comprise a guide-attachment body and a pair of guide arms. The guide-attachment body may be shaped to define a portion of the needle opening. The pair of guide arms may each extend radially inward from the guide-attachment body toward the needle of the sewing machine on opposite sides of the guide-attachment body. The pair of guide arms may be configured to engage the edge of the ruler at the two point-contact locations.

In some embodiments, the pair of guide arms may each be shaped to include a flange, a first protuberance, and a second protuberance. The flange may extend axially and radially inward from the guide-attachment body to a terminal end. The flange may have a first side surface and a second side surface opposite the first side surface. The first protuberance may extend away from the first side surface of the flange near the terminal end of the flange. The second protuberance may extend away from the second side surface of the flange near the terminal end of the flange opposite the first protuberance.

In some embodiments, the first protuberances on the pair of guide arms or the second protuberances on the pair of guide arms may form the two point-contact locations that engage the edge of the ruler. The first protuberances on the pair of guide arms may form the two point-contact locations that engage the edge of the ruler. The second protuberances on the pair of guide arms may form the two point-contact locations that engage the edge of the ruler.

In some embodiments, the first and second protuberances on each guide arm included in the pair of guide arms may extend axially part way along the axis of the hopping foot assembly. The first and second protuberances on each guide arm may extend axially part way along the axis of the hopping foot assembly past a bottom surface of the hopping foot base.

In some embodiments, the bearing may include an outer race, an inner race, and a roller located between the outer race and the inner race. The hopping foot base may be coupled to the outer race of the bearing. The guide attachment may be coupled to the inner race of the bearing.

In some embodiments, the path defined by the edge of the ruler may be linear or curved. The path defined by the edge of the ruler may be linear. The path defined by the edge of the ruler may be curved.

In some embodiments, the rotating ruler guide may comprise a guide-attachment body and a pair of guide arms. The guide-attachment body may be shaped to define a portion of the needle opening. The pair of guide arms may each extend axially and radially away from the guide-attachment body toward the needle of the sewing machine on opposite sides of the guide-attachment body. The pair of guide arms may be configured to engage the edge of the ruler at the two point-contact locations.

In some embodiments, the pair of guide arms included in the guide attachment of the rotating ruler guide may each extend axially partway along the axis of the hopping foot assembly opposite the hopping foot arm. The pair of guide arms may each extend axially partway along the axis of the hopping foot assembly opposite the hopping foot arm so that the pair of guide arms extend past a bottom surface of the hopping foot base.

In some embodiments, the pair of guide arms may each be shaped to include a flange and a pair of protuberances. The flange may extend axially and radially inward from the guide-attachment body to a terminal end. The pair of protuberances may each extend away from the flange near the terminal end of the flange on opposite sides of the flange.

In some embodiments, one protuberance included in the pair of protuberances on a first guide arm included in the pair of guide arms and one protuberance included in the pair of protuberances on a second guide arm included in the pair of guide arms form the two point-contact locations that engage the edge of the ruler. The pair of protuberances on each guide arm included in the pair of guide arms may each extend axially part way along the axis of the hopping foot assembly.

These and other features of the present disclosure will become more apparent from the following description of the illustrative embodiments.

DETAILED DESCRIPTION OF THE DRAWINGS

Figure 1:
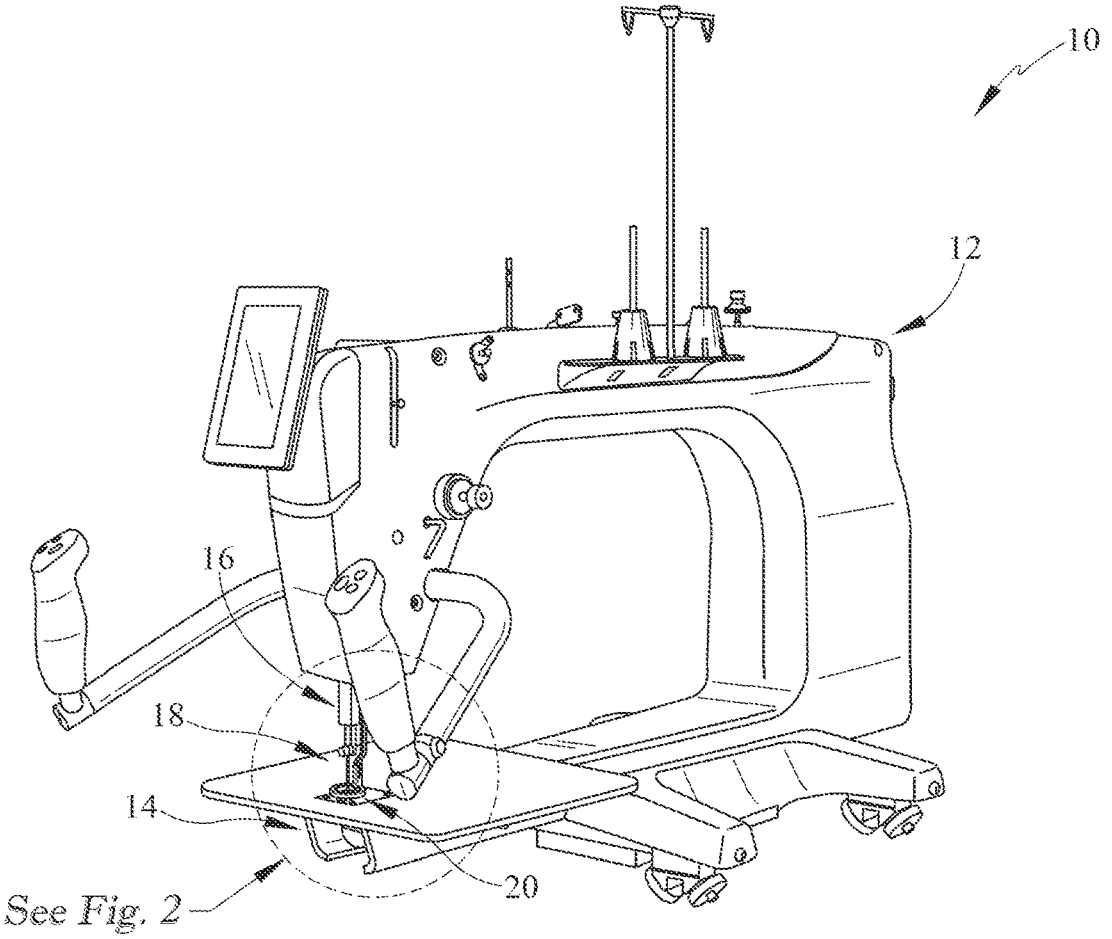
FIG. 1 is a perspective view of a sewing machine including a sewing machine body, a pressure bar, and a needle and showing a hopping foot assembly coupled to the presser bar of the sewing machine.

For the purposes of promoting an understanding of the principles of the disclosure, reference will now be made to a number of illustrative embodiments illustrated in the drawings and specific language will be used to describe the same.

Figure 2:
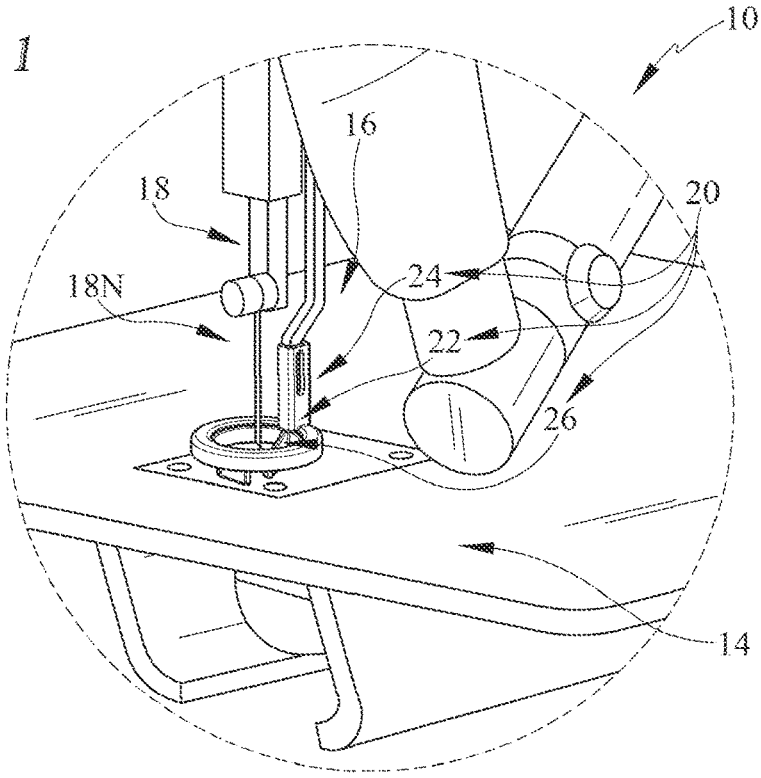
FIG. 2 is a detail view of the sewing machine of FIG. 1 showing the hopping foot assembly includes a hopping foot base shaped to include an needle opening that extends therethrough, a hopping foot arm that extends from the hooping foot base and fixes the hopping foot base relative to the sewing machine, and a rotating ruler guide coupled to the hopping foot base in the needle opening that aids a user in aligning the needle of the sewing machine with a path to be sewn in the fabric.

An illustrative embodiment of a hopping foot assembly 20 adapted for use with a sewing machine 10 is shown in FIGS. 1-6. The sewing machine 10 has a sewing machine body 12, sewing machine bed 14, a presser bar 16, and a needle bar 18 with a needle 18N coupled thereto as shown in FIGS. 1 and 2. The hopping foot assembly 20 is coupled to the presser bar 16 of the sewing machine 10 and configured to be lowered into contact with fabric to be sewn.

The hopping foot assembly 20 includes a hopping foot base 22, a hopping foot arm 24, and a rotating ruler guide 26 as shown in FIGS. 2-11. The hopping foot base 22 is circular and shaped to define a needle opening 34 that extends through the base 22 relative to an axis 28. The needle opening 34 is configured to allow the needle 18N to extend into and out of the fabric. The hopping foot arm 24 extends axially from the hopping foot base 22 and couples to the presser bar 16 of the sewing machine 10 to fix the hopping foot base 22 relative to the sewing machine 10. The rotating ruler guide 26 is coupled to the hopping foot base 22 in the needle opening 34 to define a portion of the needle opening 34 and is configured rotate about the axis 28 relative to the hopping foot base 22.

When sewing or quilting pieces of fabric together, it may be difficult for a user to guide the needle 18N of the machine 10 along a path without straying from the path. The path may be a seam, a ditch line, or another desired stitch pattern to be sewn in the fabric. The desired stich pattern may be non-linear or curved. Following the path with the needle 18N is especially difficult for free moving or maneuverable machines, which allow the user to freely move the machine 10 along the path.

Figure 7:
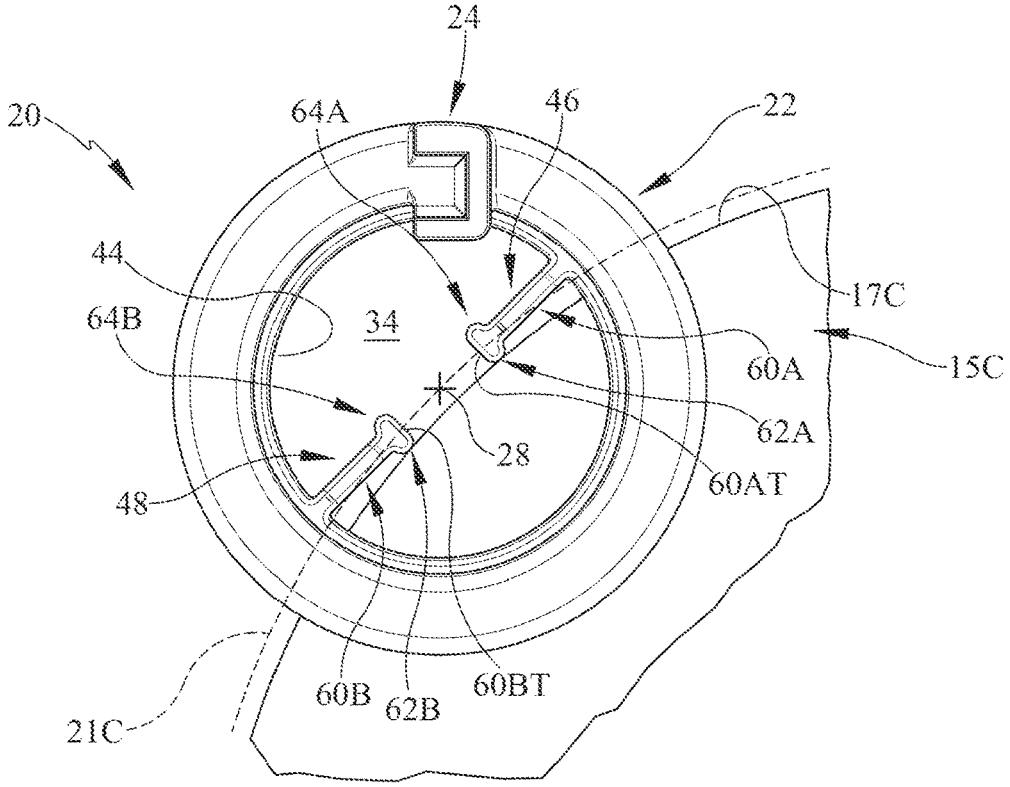
FIG. 7 is a top view of the hooping foot assembly of FIG. 3 being used with a curved-edge ruler showing one protuberance on each of the guide arms is engaged with a curved edge of the ruler to form the two point contact locations so that the needle is as close as possible to the edge of the ruler.
Figure 8:
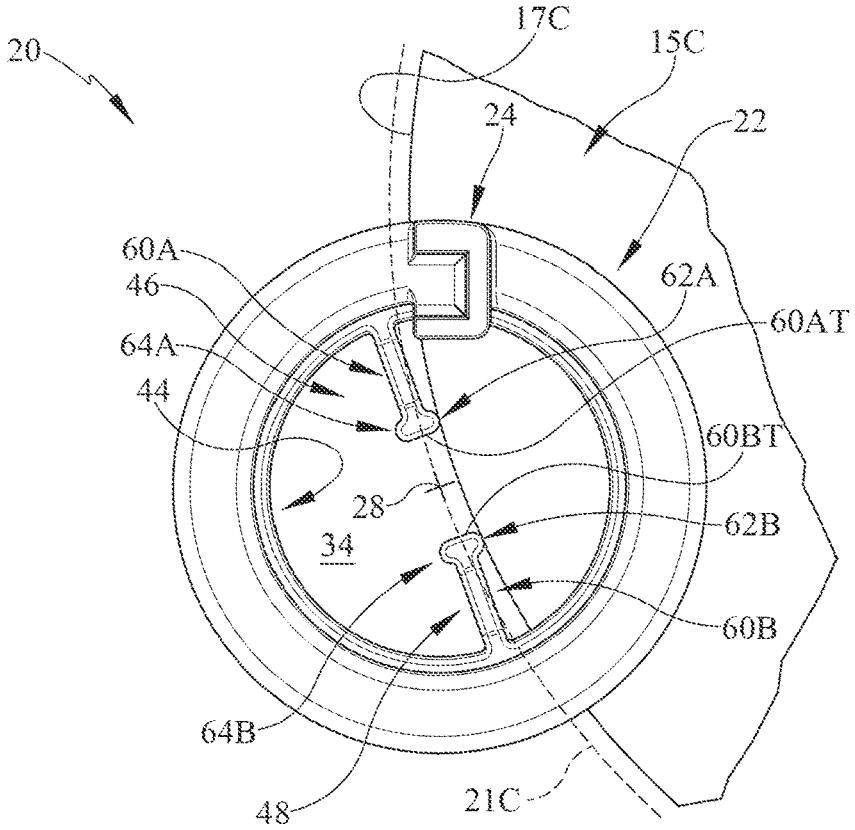
FIG. 8 is a view similar to FIG. 7 showing the hopping foot assembly has been moved along the curved edge of the ruler from a first position as shown in FIG. 7 to a second position which has caused the rotating ruler guide to rotate about the axis to maintain engagement of the rotating ruler guide with the curved edge of the ruler at the two point contact locations.
Figure 9:
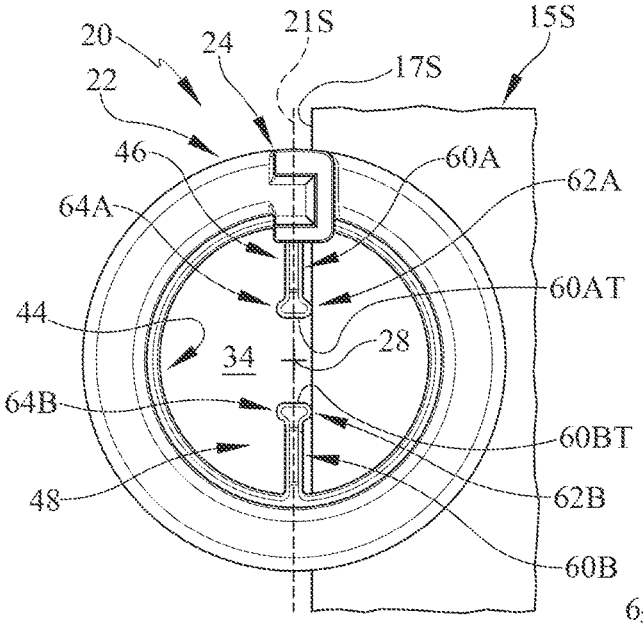
FIG. 9 is a top view of the hooping foot assembly of FIG. 3 being used with a straight-edge ruler showing one protuberance on each of the guide arms is engaged with a straight edge of the ruler in a first ruler position to form the two point contact locations.
Figure 10:
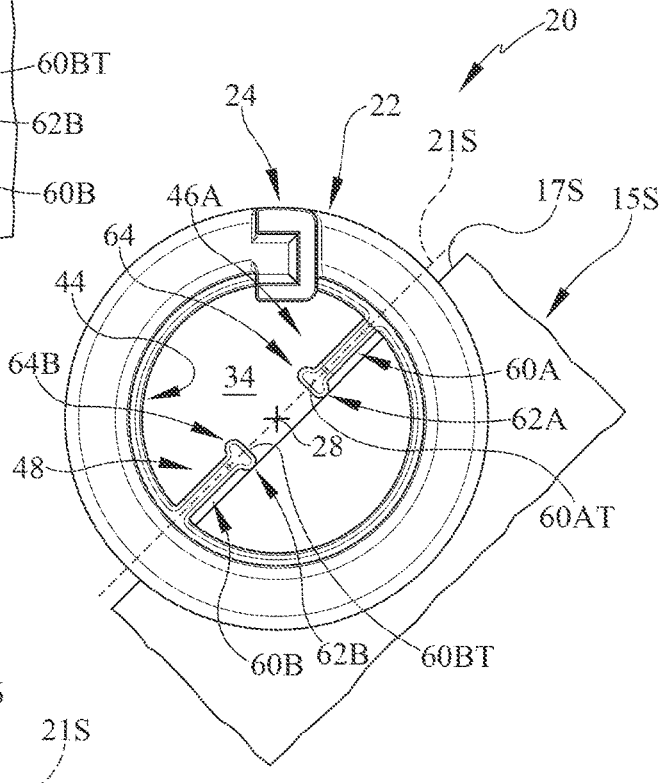
FIG. 10 is a view similar to FIG. 9 showing the rotating ruler guide engaged with the straight edge of the ruler in a second position which has caused the rotating ruler guide to rotate to maintain engagement of the rotating ruler guide with the straight edge of the ruler at the two point contact locations.
Figure 11:
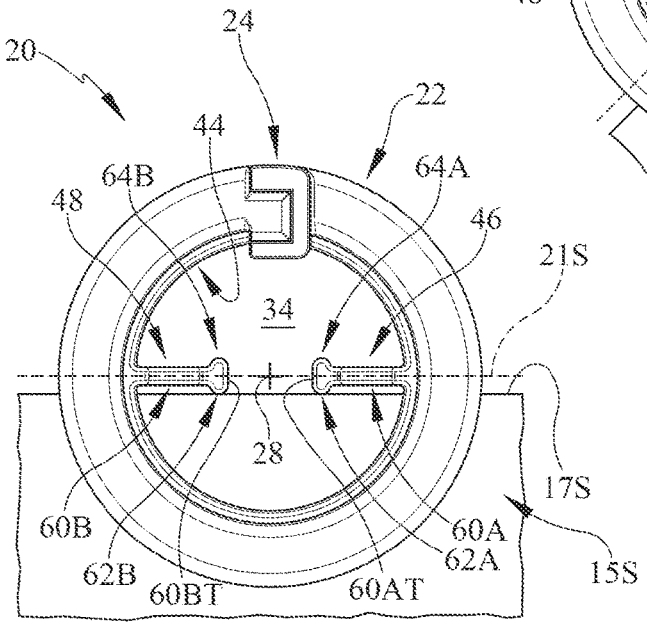
FIG. 11 is a view similar to FIG. 10 showing the rotating ruler guide engaged with the straight edge of the ruler in a third position which has caused the rotating ruler guide to rotate to maintain engagement of the rotating ruler guide with the straight edge of the ruler at the two point contact locations.

Therefore, the user may use a ruler 15C, 15S to define a path 21C, 21S to be followed by the needle 18N and help guide the hopping foot, and thus the needle 18N, along the path 21C, 21S. The ruler 15C, 15S may have a curved edge 17C as shown in FIGS. 7 and 8 or a straight edge 17S as shown in FIGS. 9-11 depending on the desired path to be sewn into the fabric. The curved edge 17C would therefore define a curved path 21C as shown in FIGS. 7 and 8, while the straight edge 17S would defines a straight path 21S as shown in FIGS. 9-11.

In some other embodiments, using a ruler 15C, 15S may offset the needle 18N from the desired path 21C, 21S. Therefore, the needle 18N follows the path 21C, 21S defined by the edge 17C, 17S of the ruler 15C, 15S at the offset distance from the edge 17C, 17S of the ruler 15C, 15S. The path 21C, 21S may be a seam, ditch line, or other pattern line. The user may account for the offset when lining up the ruler 15C, 15S to help guide the hopping foot assembly 20. However, it may be difficult to maneuver the machine 10 and the ruler 15C, 15S simultaneously, while also accounting for the offset created by the ruler 15C, 15S.

As such, the illustrative hopping foot assembly 20 includes the rotating ruler guide 26 to help the user easily guide the hopping foot assembly 20 along the ruler 15C, 15S, while keeping the needle 18N as close to the edge 17C, 17S of the ruler 15C, 15S, i.e. the path 21C, 21S, as possible as shown in FIGS. 7-11. The rotating ruler guide 26 is configured to engage the edge 17C, 17S of the ruler 15C, 15S at two point contact locations spaced apart from each other on either side of the needle 18N. In this way, the needle 18N is located closer to the edge 17C, 17S of the ruler 15C, 15S, thereby minimizing the need to account for the offset created by the ruler 15C, 15S.

Not only is the needle 18N located closed to the edge 17C, 17S of the ruler 15C, 15S, the larger diameter of the hopping foot base 22 creates good visibility for the user. While a smaller diameter hopping foot would bring the needle closed to an edge of the ruler, the needle opening would be smaller, which would make it more difficult to view where the needle is sewing. With the rotating ruler guide 26, the needle 18N is brought closer to the edge 17C, 17S of the ruler 15C, 15S, but the needle opening 34 is still wide enough to create good visibility for the user.

Additionally, the rotating ruler guide 26 is configured rotate to maintain engagement with the edge 17C, 17S of the ruler 15C, 15S at the two point contact locations. Maintaining engagement of the hopping foot assembly 20 with the edge 17C, 17S of the ruler 15C, 15S is important for following the path 21C, 21S with the needle 18N during use of the sewing machine 10. Maintaining engagement of the hopping foot assembly 20 with the edge 17C, 17S of the ruler 15C, 15S may be more difficult if the edge 17C of the ruler 15C is curved or nonlinear like as shown in FIGS. 7 and 8.

The rotating ruler guide 26 rotates to maintain engagement with the edge 17C, 17S of the ruler 15C, 15S at the two point contact locations to allow the user to easily maneuver the ruler 15C, 15S, while keeping the needle 18N close to the edge 17C, 17S of the ruler 15C, 15S. The ruler 15C, 15S may be moved around the hopping foot assembly 20 to create different paths 21C, 21S as suggested in FIGS. 7-11. The rotating ruler guide 26 may rotate as the ruler 15C, 15S is moved to maintain engagement with the ruler 15C, 15S so that the user does not need to reposition the hopping foot assembly 20 or the ruler 15C, 15S.

The rotating ruler guide 26 includes a bearing 36 and a guide attachment 38 as shown in FIGS. 3-6. The bearing 36 is coupled to the hopping foot base 22 and configured to rotate relative to the hooping foot base 22 about the axis 28. The guide attachment 38 is coupled to the bearing 36 and configured to engage the ruler 15C, 15S at the two point contact locations so as to align the needle 18N with the path 21C, 21S.

Figure 4:
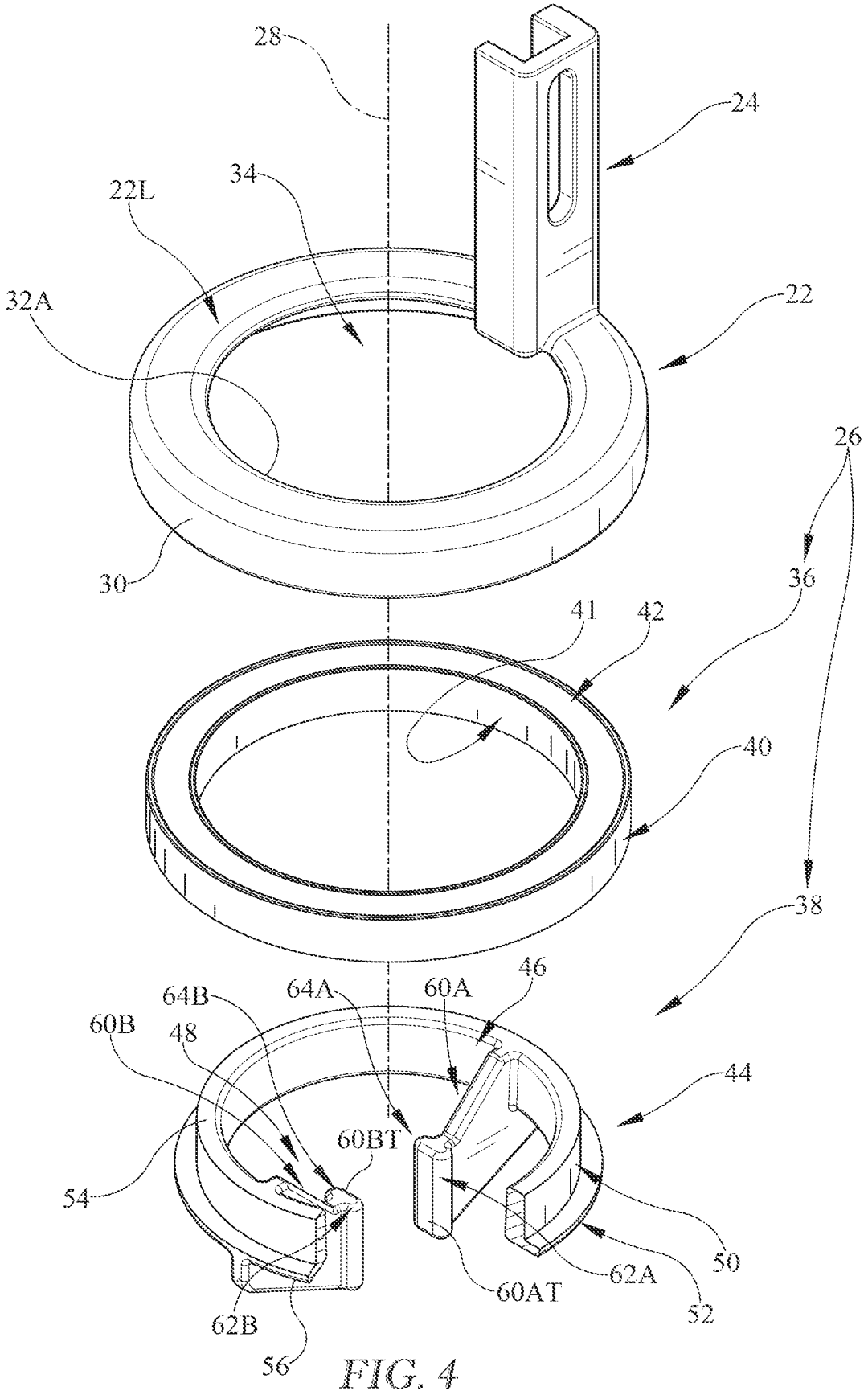
FIG. 4 is an exploded view of the hopping foot assembly of FIG. 3 showing the rotating ruler guide further includes a bearing configured to be coupled to the hopping foot base that rotates about the axis of the hooping foot assembly, and further showing the guide-attachment body extends around the axis of the hopping foot assembly to form an annular ring configured to fit into the needle opening of the hopping foot base and a portion of the annular ring is broken away to show the guide arms extend axially partway along the axis of the hopping foot assembly.
Figure 6:
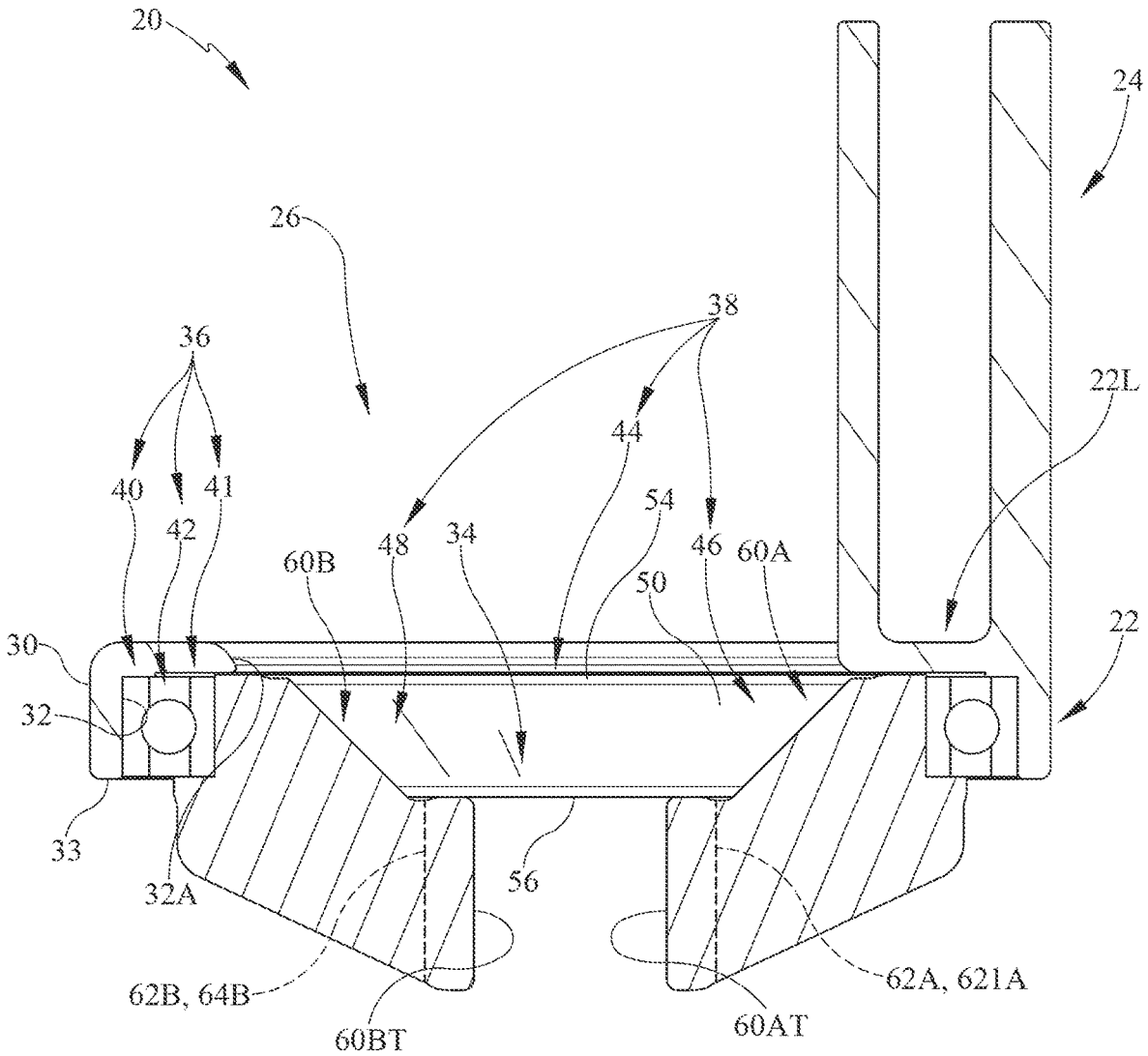
FIG. 6 is cross-section view of the hopping foot assembly of FIG. 3 showing the protuberances on each guide arm extend axially part way along the axis of the hopping foot assembly such that the protuberances on each guide arm are located axially below a bottom surface of the hopping foot base.

The bearing 36 includes an outer race 40, an inner race 41, and a roller 42 as shown in FIGS. 4 and 6. The roller 42 is located between the outer race 40 and the inner race 41. The hopping foot base 22 is coupled to the outer race 40 of the bearing 36, while the guide attachment 38 is coupled to the inner race 41 of the bearing 36. By attaching the guide attachment 38 to the inner race 41, the guide attachment 38 defines a portion of the needle opening 34 and allows the needle 18N to be close to the edge 17C, 17S of the ruler 15C, 15S.

The guide attachment 38 includes a guide-attachment body 44 and a pair of guide arms 46, 48 as shown in FIGS. 3-6. The guide-attachment body 44 is coupled to the inner race 41 of the bearing 36 and defines the portion of the needle opening 34. The guide-attachment body 44 extends around the axis 28 of the hopping foot assembly 20 to form an annular ring 50 in the illustrative embodiment. Each of guide arms 46, 48 each extend radially inward from the guide-attachment body 44 on opposite sides of the guide-attachment body 44. The pair of guide arms 46, 48 extend toward the needle 18N of the sewing machine 10 and are configured to engage the edge 17C, 17S of the ruler 15C, 15S at the two point contact locations.

Figure 5:
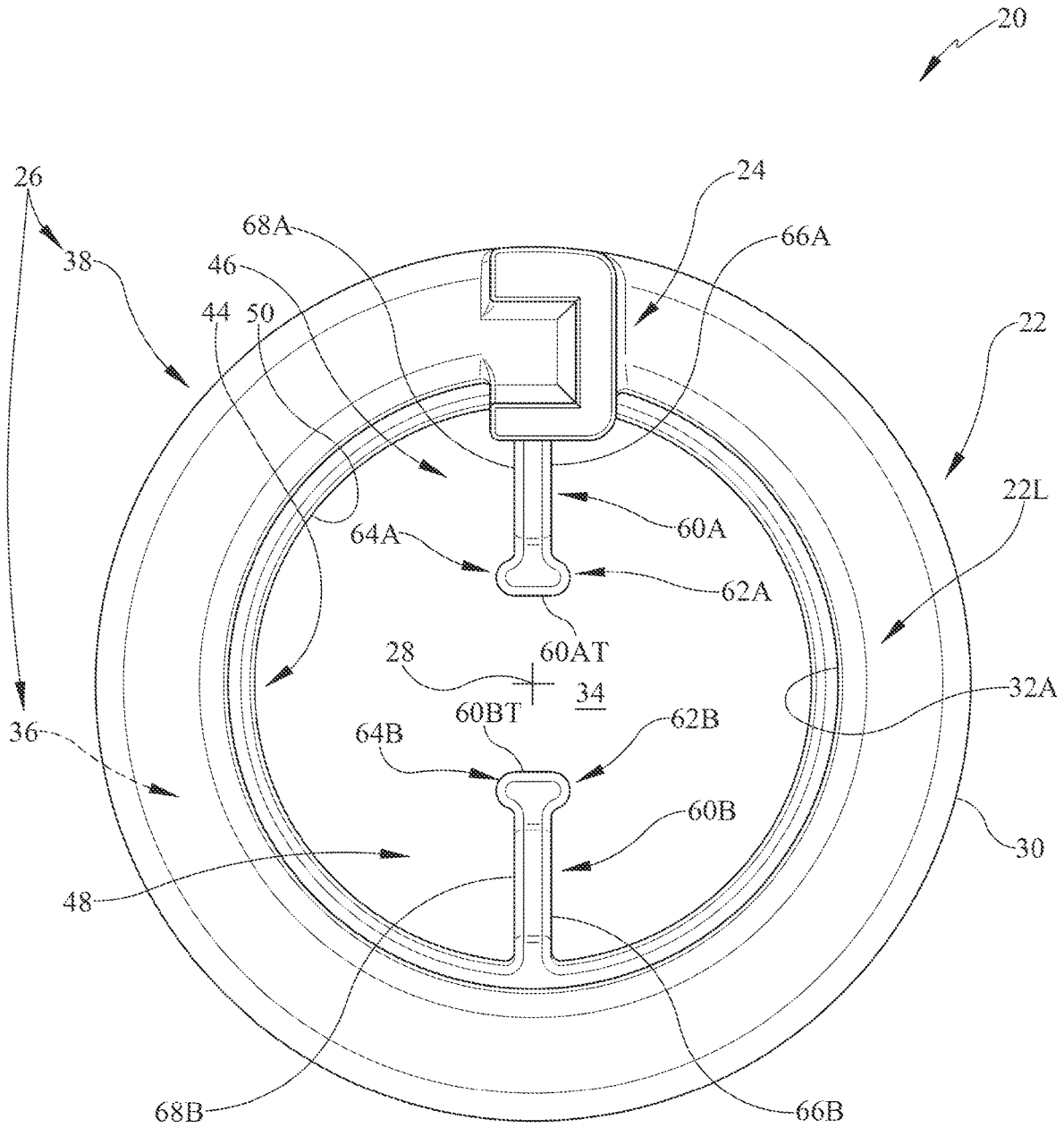
FIG. 5 is a top view of the hooping foot assembly of FIG. 3 showing each guide attachment arm includes a flange that extends radially inward from the guide-attachment body to a terminal end and a pair of protuberances that each extend away from opposite sides of the flange near the terminal end of the flange to form the two point contact locations that are configured to engage the edge of the ruler during use of the hopping foot assembly like as shown in FIGS. 7-11.

The guide-attachment body 44 is shaped to include the annular ring 50, a lip 52, a top side surface 54, and a bottom side surface 56 as shown in FIGS. 4-6. The annular ring 50 extends around the axis 28 of the hopping foot assembly 20 and extends radially between and interconnects the top and bottom side surfaces 54, 56. The lip 52 extends radially from the annular ring 50 and forms a portion of the bottom side surface 56 of the guide-attachment body 44. The bottom side surface 56 is opposite the top side surface 54 and faces the fabric.

Each of the guide arms 46, 48 includes a flange 60A, 60B and a pair of protuberances 62A, 62B, 64A, 64B as shown in FIGS. 4-11. The flange 60A, 60B extends axially partway along the axis 28 and radially inward from the guide-attachment body 44 to a terminal end 60AT, 60BT. The terminal end 60AT, 60BT of the flanges 60A, 60B are adjacent to the needle 18N, i.e. the axis 28 as shown in FIG. 5. Each protuberances 62A, 62B, 64A, 64B extends away from the respective flange 60A, 60B near the terminal end 60AT, 60BT of the respective flange 60A, 60B on opposite sides 66A, 66B, 68A, 68B of the respective flange 60A, 60B.

Each respective flange 60A, 60B has a first side surface 66A, 66B and a second side surface 68A 68B opposite the first side surface as shown in FIG. 5. The first protuberance 62A on the first flange 60A extends away from the first side surface 66A of the flange 60A near the terminal end 60AT of the flange 60A. The second protuberance 64A on the first flange 60A extends away from the second side surface 68A of the flange 60A near the terminal end 60AT of the flange 60A opposite the first protuberance 62A. Similarly, the first protuberance 62B on the first flange 60B extends away from the first side surface 66B of the flange 60B near the terminal end 60BT of the flange 60B. The second protuberance 64B on the first flange 60B extends away from the second side surface 68B of the flange 60B near the terminal end 60BT of the flange 60B opposite the first protuberance 62B.

The first protuberances 62A, 62B on the pair of guide arms 46, 48 or the second protuberances 64A, 64B on the pair of guide arms 46, 48 form the two point contact locations that engage the edge 17C, 17S of the ruler 15C, 15S. In the illustrative embodiments, the first protuberances 62A, 62B on the pair of guide arms 46, 48 form the two point contact locations that engage the edge 17C, 17S of the ruler 15C, 15S as shown in FIGS. 7-11. Alternatively, the second protuberances 64A, 64B on the pair of guide arms 46, 48 may form the two point contact locations that engage the edge 17C, 17S of the ruler 15C, 15S.

In the illustrative embodiment, the pair of guide arms 46, 48 included in the guide attachment 38 of the rotating ruler guide 26 each extend axially partway along the axis 28 opposite the hopping foot arm 24. The pair of guide arms 46, 48 each extend axially partway along the axis 28 so that the pair of guide arms 46, 48 extend past a bottom surface 33 of the hopping foot base 22 as shown in FIG. 6. In this way, the ruler 15C, 15S engages with the hopping foot assembly 20 below the hopping foot base 22 such that the hopping foot base overlaps the ruler 15C, 15S as shown in FIGS. 7-11. This allows the needle 18N to be as close to the edge 17C, 17S of the ruler 15C, 15S as possible.

Figure 3:
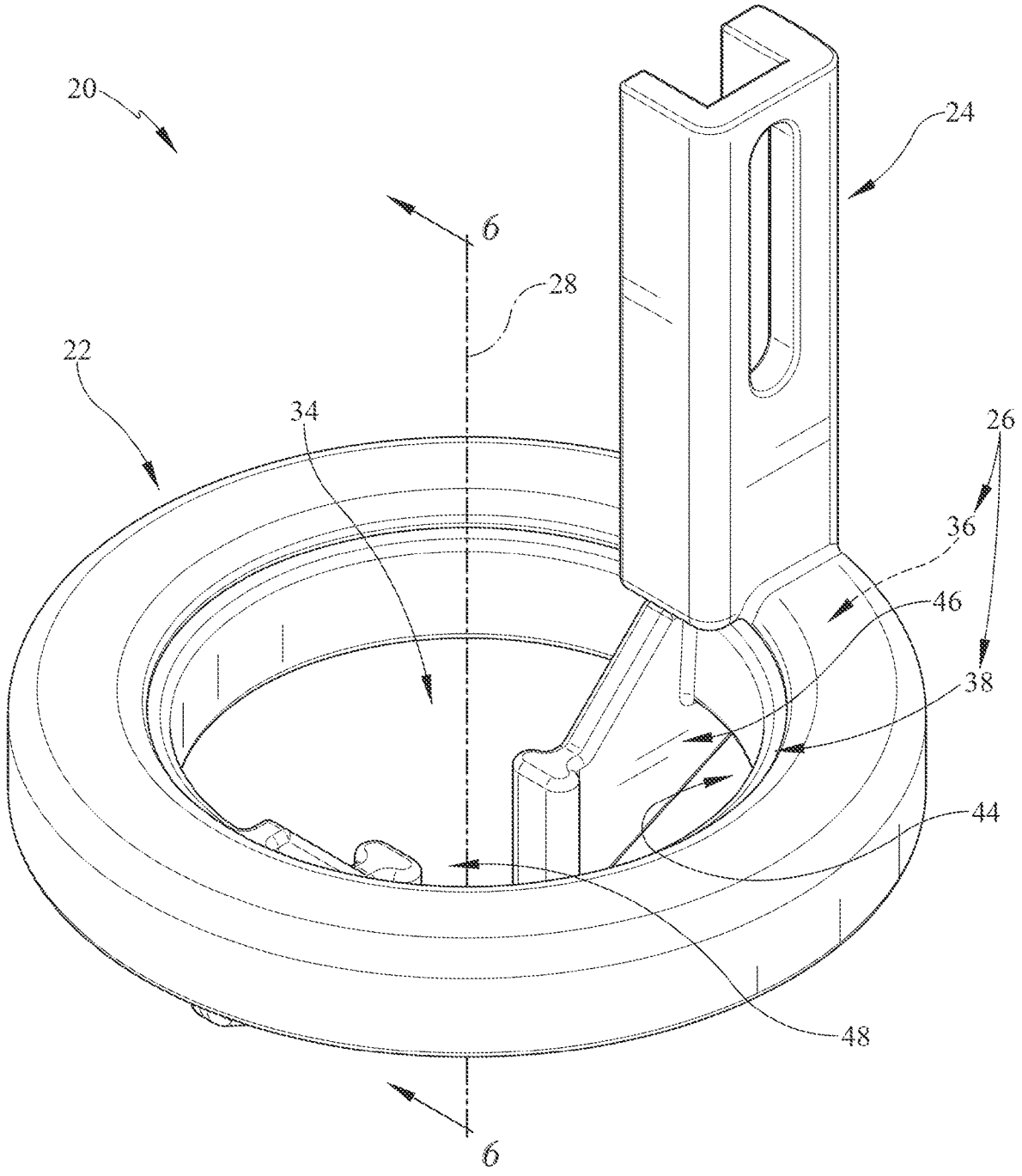
FIG. 3 is a perspective view of the hopping foot assembly of FIG. 2 showing the rotating ruler guide includes a guide attachment located in the needle opening so as to be engaged with an edge of a ruler that defines the path to be sewn in the fabric, and further showing the guide attachment includes a guide-attachment body and a pair of guide arms that each extend radially inward from the guide-attachment body on opposite sides of the guide-attachment body to provide two point contact locations that engage with the edge of the ruler to align the needle with the path.

In the illustrative embodiment, the first and second protuberances 62A, 62B, 64A, 64B on each guide arm 46, 48 included in the pair of guide arms 46, 48 extend axially part way along the axis 28 of the hopping foot assembly 20 as shown in FIG. 3. The first and second protuberances 62A, 62B, 64A, 64B on each guide arm 46, 48 included in the pair of guide arms 46, 48 are located axially below the bottom surface 33 of the hopping foot base 22 as suggested in FIG. 6.

Turning again to the hopping foot base 22, the hopping foot base 22 is formed to define an outer surface 30, an inner surface 32, the bottom surface 33, and the needle opening 34 as shown in FIGS. 4-6. The inner surface 32 is opposite the outer surface 30. The inner surface 32 defines the needle opening 34 that extends axially through the base 22. The inner race 41 of the bearing 36 is coupled to the inner surface 32 of the hopping foot base 22.

In the illustrative embodiment, the hopping foot base 22 has a lip 22L that extends over the bearing 36 as shown in FIGS. 5 and 6. The lip 22L forms a portion 32A of the inner surface 32 of the hopping foot base 22.

To use the hopping foot assembly 20, the user places the ruler 15C, 15S on the fabric arranged on the machine bed 14. The user then engages either the first protuberances 62A, 62B on the pair of guide arms 46, 48 or the second protuberances 64A, 64B on the pair of guide arms 46, 48 with the edge 17C, 17S of the ruler 15C, 15S. In the illustrative embodiment, the user engages the first protuberances 62A, 62B on the pair of guide arms 46, 48 with the edge 17C, 17S of the ruler 15C, 15S to form the two point contact locations on the ruler 15C, 15S as shown in FIGS. 7-11.

For the curved ruler embodiment, the user engages the first protuberances 62A, 62B on the pair of guide arms 46, 48 with the curved edge 17C of the ruler 15C to form the two point contact locations on the ruler 15C as shown in FIGS. 7 and 8. The user then moves the sewing machine 10 along the curved path 21C while keeping the first protuberances 62A, 62B on the pair of guide arms 46, 48 engaged with the curved edge 17C of the ruler 15C. In this way, the needle 18N follows the curved path 21C and stitches the desired stich line 21C as suggested in FIGS. 7 and 8.

Initially, the hopping foot assembly 20 is located in a first position as shown in FIG. 7, at which the first protuberances 62A, 62B on the pair of guide arms 46, 48 are engaged with the curved edge 17C of the ruler 15C to form the two point contact locations on the ruler 15C. The user then maneuvers the sewing machine 10 to cause the hooping foot assembly 20 to move from the first position as shown in FIG. 7 to a second position as shown in FIG. 8. This causes the rotating ruler guide 26 to rotate about the axis 28 to maintain engagement of the rotating ruler guide 26 with the curved edge 17C of the ruler 15C at the two point contact locations as shown in FIG. 8.

For the straight ruler embodiment, the user engages the first protuberances 62A, 62B on the pair of guide arms 46, 48 with the straight edge 17S of the ruler 15S to form the two point contact locations on the ruler 15S as shown in FIGS. 9-11. The user then moves the sewing machine 10 along the straight path 21S while keeping the first protuberances 62A, 62B on the pair of guide arms 46, 48 engaged with the straight edge 17S of the ruler 15S. In this way, the needle 18N follows the straight path 21S and stitches the desired stich line 21S as suggested in FIGS. 9-11.

In the illustrative embodiment, the first protuberances 62A, 62B on the pair of guide arms 46, 48 are engaged with the straight edge 17S of the ruler 15S in a first position as shown in FIG. 9. In the first position, the ruler 15S extends vertically. The ruler 15S may be arranged on either side of the rotating ruler guide 26 in the vertical first position so as to engage either the first protuberances 62A, 62B on the pair of guide arms 46, 48 or the second protuberances 64A, 64B on the pair of guide arms 46, 48.

For instance, the ruler 15S may be arranged so that the second protuberances 64A, 64B on the pair of guide arms 46, 48 of the guide attachment 38 may be engaged with the edge 17S of the ruler 15S while the ruler 15S is in the first position. The rotating ruler guide 26 may be rotated until one of the either the first protuberances 62A, 62B on the pair of guide arms 46, 48 or the second protuberances 64A, 64B on the pair of guide arms 46, 48 engages the edge 17S of the ruler 15S in the first position.

If the path 21S changes direction, i.e. the user wants/needs to sew a different seam, ditch line, or pattern line, the user may adjust the position of the ruler 15S as suggested in FIGS. 10 and 11. Similarly, if the path 21C changes direction, i.e. the user wants/needs to sew a different seam, ditch line, or pattern line, the user may adjust the position of the ruler 15C like how the user would adjust the ruler 15S.

To adjust the position of the ruler 15C, 15S, the user moves the ruler 15C, 15S keeping the edge 17C, 17S engaged with either the first protuberances 62A, 62B on the pair of guide arms 46, 48 or the second protuberances 64A, 64B on the pair of guide arms 46, 48. The first edge surface 62 is kept engaged with the edge 17C, 17S of the ruler 15C, 15S as the position of the ruler 15C, 15S is adjusted in the illustrative embodiment. The ruler 15C, 15S is moved until the edge 17C, 17S of the ruler 15C, 15S defines the desired path 21C, 21S to be followed.

In the illustrative embodiment, the ruler 15S is moved from the first position to a second position as shown in FIG. 10. In the second position, the ruler 15S extends at an angle relative to the first position. The angle may vary as the rotating ruler guide 26 is configured to rotate 360 degrees about the axis 28. The first protuberances 62A, 62B on the pair of guide arms 46, 48 remain engaged with the edge 17S of the ruler 15S in the second position as shown in FIG. 10.

In the illustrative embodiment, the ruler 15S may also be moved from one of the first position and the second position to a third position as shown in FIG. 11. In the third position, the ruler 15S extends horizontally. The ruler 15S may be arranged on either side of the rotating ruler guide 26 in the horizontal third position. The first protuberances 62A, 62B on the pair of guide arms 46, 48 remain engaged with the edge 17S of the ruler 15S in the third position as shown in FIG. 11.

Compared to other hopping foot assemblies, the rotating ruler guide 26 of the hopping foot assembly 20 helps the user easily guide the hopping foot assembly 20 along the ruler 15C, 15S, while keeping the needle 18N as close to the edge 17C, 17S of the ruler 15C, 15S as possible. Moreover, the rotating ruler guide 26 also helps maintain better engagement with a curved or nonlinear edge 17C of a ruler 15C. This makes it easier for the user to maneuver the sewing machine 10 to follows the desired path 21C, 21S.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A hopping foot assembly for a sewing machine having a needle, the hopping foot assembly comprising:

a circular hopping foot base shaped to include an outer surface and an inner surface;

the inner surface defining a needle opening that extends axially through the circular hopping foot base relative to an axis of the hopping foot assembly to allow the needle to extend into and out of fabric during use of the sewing machine;

a hopping foot arm that extends axially from the hopping foot base relative to the axis of the hopping foot assembly and configured to be coupled to the sewing machine to fix the hopping foot base relative to the sewing machine; and a rotating ruler guide coupled to the inner surface of the hopping foot base in the needle opening to define a portion of the needle opening, wherein the rotating ruler guide engages an edge of a ruler at two point-contact locations spaced apart from each other on either side of the needle so that the needle is located adjacent to the edge of the ruler and rotates about the axis of the hopping foot assembly relative to the hopping foot base to maintain engagement of the rotating ruler guide with the edge of the ruler at the two point-contact locations to allow a user to follow a path defined by the edge of the ruler with the needle of the sewing machine during use of the sewing machine.

2. The hopping foot assembly of claim 1, wherein the rotating ruler guide comprises:

a bearing coupled to the inner surface of the hopping foot base and configured to rotate about the axis of the hopping foot assembly; and a guide attachment coupled to the bearing to rotate therewith, the guide attachment comprising:

a guide-attachment body that extends around the axis of the hopping foot assembly to form an annular ring that defines the portion of the needle opening; and a pair of guide arms that each extend radially inward from the guide-attachment body toward the needle of the sewing machine on opposite sides of the guide-attachment body, the pair of guide arms configured to engage the edge of the ruler at the two point-contact locations so as to align the needle with the path.

3. The hopping foot assembly of claim 2, wherein the pair of guide arms are each shaped to include:

a flange that extends axially and radially inward from the guide-attachment body to a terminal end adjacent to the needle of the sewing machine, the flange having a first side surface and a second side surface opposite the first side surface;

a first protuberance that extends away from the first side surface of the flange adjacent to the terminal end of the flange; and a second protuberance that extends away from the second side surface of the flange adjacent to the terminal end of the flange opposite the first protuberance, wherein the first protuberances on the pair of guide arms or the second protuberances on the pair of guide arms form the two point-contact locations that engage the edge of the ruler.

4. The hopping foot assembly of claim 3, wherein the first and second protuberances on each guide arm included in the pair of guide arms extend axially part way along the axis of the hopping foot assembly past a bottom surface of the hopping foot base.

5. The hopping foot assembly of claim 2, wherein the pair of guide arms included in the guide attachment of the rotating ruler guide each extend axially partway along the axis of the hopping foot assembly opposite the hopping foot arm so that the pair of guide arms extend past a bottom surface of the hopping foot base.

6. The hopping foot assembly of claim 2, wherein the bearing includes an outer race, an inner race, and a roller located between the outer race and the inner race, the hopping foot base is coupled to the outer race of the bearing, and the guide-attachment body is coupled to the inner race of the bearing.

7. The hopping foot assembly of claim 1, wherein the path defined by the edge of the ruler is linear or curved.

8. The hopping foot assembly of claim 1, wherein the rotating ruler guide comprises:

a guide-attachment body that extends around the axis of the hopping foot assembly to form an annular ring that defines the portion of the needle opening; and a pair of guide arms that each extend axially and radially away from the guide-attachment body toward the needle of the sewing machine on opposite sides of the guide-attachment body, the pair of guide arms configured to engage the edge of the ruler at the two point-contact locations so as to align the needle with the path.

9. The hopping foot assembly of claim 8, wherein the pair of guide arms are each shaped to include:

a flange that extends axially and radially inward from the guide-attachment body to a terminal end; and a pair of protuberances that each extend away from the flange at the terminal end of the flange on opposite sides of the flange, wherein one protuberance included in the pair of protuberances on a first guide arm included in the pair of guide arms and one protuberance included in the pair of protuberances on a second guide arm included in the pair of guide arms form the two point-contact locations that engage the edge of the ruler.

10. The hopping foot assembly of claim 9, wherein the pair of protuberances on each guide arm included in the pair of guide arms each extends axially part way along the axis of the hopping foot assembly past a bottom surface of the hopping foot base.

11. A hopping foot assembly for a sewing machine having a needle, the hopping foot assembly comprising:

a ruler;

a circular hopping foot base shaped to include an outer surface and an inner surface;

the inner surface defining a needle opening that extends axially through the circular hopping foot base relative to an axis of the hopping foot assembly to allow the needle to extend into and out of fabric during use of the sewing machine;

a hopping foot arm that extends from the hopping foot base and configured to be coupled to the sewing machine to fix the hopping foot base relative to the sewing machine; and a rotating ruler guide coupled to the hopping foot base in the needle opening and configured to engage an edge of the ruler at two point-contact locations spaced apart from each other on either side of the needle, wherein the rotating ruler guide is configured to rotate about the axis of the hopping foot assembly relative to the hopping foot base to maintain engagement of the rotating ruler guide with the edge of the ruler at the two point-contact locations during use of the sewing machine.

12. A hopping foot assembly for a sewing machine having a needle, the hopping foot assembly comprising:

a hopping foot base shaped to include a needle opening that extends axially therethrough relative to an axis of the hopping foot assembly;

a hopping foot arm that extends from the hopping foot base and configured to be coupled to the sewing machine to fix the hopping foot base relative to the sewing machine; and a rotating ruler guide coupled to the hopping foot base in the needle opening and configured to engage an edge of a ruler at two point-contact locations other on either side of the needle, wherein the rotating ruler guide is configured to rotate about the axis of the hopping foot assembly relative to the hopping foot base to maintain engagement of the rotating ruler guide with the edge of the ruler at the two point-contact locations during use of the sewing machine, and wherein the rotating ruler guide comprises:

a bearing coupled to the hopping foot base and configured to rotate about the axis of the hopping foot assembly; and a guide attachment coupled to the bearing to rotate therewith, the guide attachment comprising:

a guide-attachment body shaped to define a portion of the needle opening; and a pair of guide arms that each extend radially inward from the guide-attachment body toward the needle of the sewing machine on opposite sides of the guide-attachment body, the pair of guide arms configured to engage the edge of the ruler at the two point-contact locations.

13. The hopping foot assembly of claim 12, wherein the pair of guide arms are each shaped to include:

a flange that extends axially and radially inward from the guide-attachment body to a terminal end, the flange having a first side surface and a second side surface opposite the first side surface;

a first protuberance that extends away from the first side surface of the flange adjacent to the terminal end of the flange; and a second protuberance that extends away from the second side surface of the flange adjacent to the terminal end of the flange opposite the first protuberance, wherein the first protuberances on the pair of guide arms or the second protuberances on the pair of guide arms form the two point-contact locations that engage the edge of the ruler.

14. The hopping foot assembly of claim 13, wherein the first and second protuberances on each guide arm included in the pair of guide arms extend axially part way along the axis of the hopping foot assembly past a bottom surface of the hopping foot base.

15. The hopping foot assembly of claim 12, wherein the bearing includes an outer race, an inner race, and a roller located between the outer race and the inner race, the hopping foot base is coupled to the outer race of the bearing, and the guide attachment is coupled to the inner race of the bearing.

16. The hopping foot assembly of claim 11, wherein the path defined by the edge of the ruler is linear or curved.

17. The hopping foot assembly of claim 11, wherein the rotating ruler guide comprises:

a guide-attachment body shaped to define a portion of the needle opening; and a pair of guide arms that each extend axially and radially away from the guide-attachment body toward the needle of the sewing machine on opposite sides of the guide-attachment body, the pair of guide arms configured to engage the edge of the ruler at the two point-contact locations.

18. The hopping foot assembly of claim 17, wherein the pair of guide arms included in the guide attachment of the rotating ruler guide each extend axially partway along the axis of the hopping foot assembly opposite the hopping foot arm so that the pair of guide arms extend past a bottom surface of the hopping foot base.

19. The hopping foot assembly of claim 17, wherein the pair of guide arms are each shaped to include:

a flange that extends axially and radially inward from the guide-attachment body to a terminal end; and a pair of protuberances that each extend away from the flange at the terminal end of the flange on opposite sides of the flange, wherein one protuberance included in the pair of protuberances on a first guide arm included in the pair of guide arms and one protuberance included in the pair of protuberances on a second guide arm included in the pair of guide arms form the two point-contact locations that engage the edge of the ruler.

20. The hopping foot assembly of claim 19, wherein the pair of protuberances on each guide arm included in the pair of guide arms each extends axially part way along the axis of the hopping foot assembly.

* * * * *